US011898347B2

(12) United States Patent
Brown et al.

(10) Patent No.: US 11,898,347 B2
(45) Date of Patent: Feb. 13, 2024

(54) SLIDING DOOR FOR USE IN A MODULAR WALL SYSTEM

(71) Applicant: HNI Technologies Inc., Muscatine, IA (US)

(72) Inventors: Matthew C. Brown, Wilton, IA (US); John Hoelzer, Muscatine, IA (US); Kaelan Abernathey, Cedar Rapids, IA (US); Sean Oliver, Iowa City, IA (US)

(73) Assignee: HNI TECHNOLOGIES INC., Muscatine, IA (US)

( * ) Notice: Subject to any disclaimer, the term of this patent is extended or adjusted under 35 U.S.C. 154(b) by 0 days.

(21) Appl. No.: 17/690,780

(22) Filed: Mar. 9, 2022

(65) Prior Publication Data

US 2022/0290426 A1 Sep. 15, 2022

Related U.S. Application Data

(60) Provisional application No. 63/158,746, filed on Mar. 9, 2021.

(51) Int. Cl.
*E04B 2/74* (2006.01)
*E04B 2/82* (2006.01)

(52) U.S. Cl.
CPC ..... *E04B 2/7401* (2013.01); *E04B 2/7455* (2013.01); *E04B 2/821* (2013.01); *E04B 2002/7461* (2013.01); *E04B 2002/7483* (2013.01)

(58) Field of Classification Search
CPC .... E04B 2/7401; E04B 2/7403; E04B 2/7409; E04B 2/7412; E04B 2/7414; E04B 2/7435; E04B 2/7448; E04B 2/745; E04B 2/7453; E04B 2/7455; E04B 2002/7418; E06B 3/26347; E06B 3/4636; E06B 5/20; E06B 7/18; E06B 7/21; E06B 7/22; E06B 7/72305; E06B 7/231; E06B 7/2312; E06B 7/2316
See application file for complete search history.

(56) References Cited

U.S. PATENT DOCUMENTS 6,772,560 B2 * 8/2004 Dischiant ..... E06B 7/23 49/197
8,881,464 B1 * 11/2014 Huckeba ..... E06B 1/6046 49/489.1
2003/0089057 A1 * 5/2003 Wiechecki ..... E04B 2/745 52/238.1

(Continued)

*Primary Examiner* — Kyle J. Walraed-Sullivan
(74) *Attorney, Agent, or Firm* — Faegre Drinker Biddle & Reath LLP

(57) ABSTRACT

Various aspects of the present disclosure are directed toward apparatuses, systems, and methods for a modular wall system. The modular wall system may include a panel frame; a sliding door including a first vertical side, a second vertical side, an upper surface, and a lower surface; sliding door hardware coupled to the upper surface of the sliding door configured to translate the sliding door within the panel frame; and a sliding track seal arranged with the header including a substantially linear portion extending from the header and a curved portion configured to maintain contact with the sliding door in a closed configuration, an open configuration, and in transitioning between the open configuration and the closed configuration.

25 Claims, 14 Drawing Sheets

(56) References Cited

U.S. PATENT DOCUMENTS

| | | | | |
|---|---|---|---|---|
| 2012/0317899 | A1* | 12/2012 | Von Hoyningen Huene | E04B 2/7407 52/127.7 |
| 2014/0173991 | A1* | 6/2014 | Saunders | E05D 15/0686 49/411 |
| 2015/0360835 | A1* | 12/2015 | Vorwerk | A61L 2/26 220/361 |
| 2016/0273260 | A1* | 9/2016 | Jolie | E06B 1/70 |
| 2018/0087302 | A1* | 3/2018 | Hegner | E06B 3/4636 |
| 2021/0010324 | A1* | 1/2021 | Hawkinson | E06B 7/23 |
| 2021/0047880 | A1* | 2/2021 | Gosling | E06B 7/2309 |

* cited by examiner

SLIDING DOOR FOR USE IN A MODULAR WALL SYSTEM

CROSS REFERENCE TO RELATED APPLICATION

This application claims priority to Provisional Application No. 63/158,746, filed Mar. 9, 2021, which is herein incorporated by reference in its entirety.

BACKGROUND

Fixed wall systems, moveable wall systems, and non-progressive wall systems are very well known in the art.

Some problems associated with fixed wall systems are the inability to displace and/or move the fixed wall systems once they are mounted. Fixed wall systems are also disadvantageous because their installation is quite lengthy. Some of the problems associated with moveable wall systems are that, very often, their components are over-engineered (e.g. too heavy), they require different and specialized tooling for assembling such moveable wall systems, and they generally comprise various different components which are not readily interchangeable. Some of the problems associated with non-progressive wall systems are the inability to independently change, move, and/or alter a particular component of the non-progressive wall system without affecting the other components operatively connected to the particular component.

Hence, in light of the aforementioned, there is a need for an improved system which, by virtue of its design and components, would be able to overcome or at least minimize some of the aforementioned prior art problems.

SUMMARY

According to one example ("Example 1"), a modular wall system includes a panel frame for use with the wall panel system including a first panel member, a second panel member, a header extending between the first panel member and the second panel member on a first side, a footer extending between the first panel member and the second panel member on a second side; a sliding door including a first vertical side, a second vertical side, an upper surface, and a lower surface; a sliding door hardware coupled to the upper surface of the sliding door configured to translate the sliding door within the panel frame; and a sliding track seal arranged with the header including a substantially linear portion extending from the header and a curved portion configured to maintain contact with the sliding door in a closed configuration, an open configuration, and in transitioning between the open configuration and the closed configuration.

According to another example ("Example 2"), further to the system of Example 1, the substantially linear portion is approximately aligned with the first vertical side of the sliding door.

According to another example ("Example 3"), further to the system of Example 1, the header of the panel frame includes a t-shaped slot configured to interface with a corresponding t-shaped portion of the sliding track seal.

According to another example ("Example 4"), further to the system of Example 1, the sliding track seal is configured to acoustically seal a gap between the upper surface of the sliding door and the panel frame and maintain low friction contact between the upper surface of the sliding door and the panel frame in transitioning between the open configuration and the closed configuration. The low friction contact may be to maintain function of use within Americans with Disabilities Act (ADA) guidelines.

According to another example ("Example 5"), further to the system of Example 1, further including a footer seal arranged with the lower surface of the sliding door and including a first linear section, a first bend section, and a second bend section, with at least one of the first linear section, the first bend section, and the second bend section including a variable width.

According to another example ("Example 6"), further to the system of Example 5, the footer seal is configured to compress between the lower surface of the sliding door and a floor to acoustically seal a gap between the lower surface of the sliding door and the floor and maintain low friction contact between the lower surface of the sliding door and the floor in transitioning between the open configuration and the closed configuration. The low friction contact may be to maintain function of use within Americans with Disabilities Act (ADA) guidelines.

According to another example ("Example 7"), further to the system of Example 1, the sliding door is frameless and includes a floor seal, and further including a floor guide including an inclined portion configured to facilitate movement of the floor seal along and within the floor guide when the sliding door transitioning between the open configuration and the closed configuration.

According to another example ("Example 8"), further to the system of Example 7, the floor seal is configured to friction fit with the frameless sliding door.

According to another example ("Example 9") further to the system of Example 7, the floor guide includes two different material properties to facilitate movement of the floor seal along and within the floor guide.

According to another example ("Example 10"), further to the system of Example 1, further including a data gasket arranged with the panel frame and configured to seal against electrical components and data ports routed with the panel frame.

According to another example ("Example 11"), further to the system of Example 1, further including a base trim arranged with the panel frame and a base trim gasket arranged along a length of the base trim and configured to reduce air gaps between the base trim and the sliding door.

According to another example ("Example 12"), further to the system of Example 1, further including a ceiling channel sound seal arranged with the header of the panel frame and a ceiling gasket arranged with the ceiling channel sound seal configured to close off an air gap between the panel frame and the ceiling channel sound seal.

According to another example ("Example 13"), further to the system of Example 12, the ceiling gasket is a pair of ceiling gaskets.

According to another example ("Example 14"), further to the system of Example 1, further including a corner insert is arranged at each corner of the panel frame configured to close air gaps between the sliding door and the panel frame.

According to one example ("Example 15"), a modular wall system includes a panel frame for use with the wall panel system including a first panel member, a second panel member, a header extending between the first panel member and the second panel member on a first side, a footer extending between the first panel member and the second panel member on a second side; a sliding door including a first vertical side, a second vertical side, an upper surface, and a lower surface; a sliding door hardware coupled to the upper surface of the sliding door configured to translate the sliding door within the panel frame; a plurality of gaskets arranged with the panel frame or the sliding door configured to seal air gaps between the sliding door and the panel frame to acoustically seal the sliding door within the panel frame, the plurality of gaskets including at least one of: a sliding track seal including a substantially linear portion extending from the header and a curved portion configured to maintain contact with the sliding door in a closed configuration, an open configuration, and in transitioning between the open configuration and the closed configuration, a footer seal arranged with the lower surface of the sliding door and including a first linear section, a first bend section, and a second bend section, with at least one of the first linear section, the first bend section, and the second bend section including a variable width, a ceiling gasket arranged with a ceiling channel sound seal that is arranged with the header of the panel frame and configured to close off an air gap between the panel frame and the ceiling channel sound seal, and a corner insert arranged at each corner of the sliding door configured to close air gaps between the sliding door and the panel frame.

According to another example ("Example 16"), further to the system of Example 15, the substantially linear portion of the sliding track seal is approximately aligned with the first vertical side of the sliding door.

According to another example ("Example 17"), further to the system of Example 15, the header of the panel frame includes a t-shaped slot configured to interface with a corresponding t-shaped portion of the sliding track seal.

According to another example ("Example 18"), further to the system of Example 15, the sliding track seal is configured to acoustically seal a gap between the upper surface of the sliding door and the panel frame and maintain low friction contact between the upper surface of the sliding door and the panel frame in transitioning between the open configuration and the closed configuration. The low friction contact may be to maintain function of use within ADA guidelines.

According to another example ("Example 19"), further to the system of Example 15, the footer sealer is configured to compress between the lower surface of the sliding door and a floor to acoustically seal a gap between the lower surface of the sliding door and the floor and maintain low friction contact between the lower surface of the sliding door and the floor in transitioning between the open configuration and closed configuration. The low friction contact may be to maintain function of use within ADA guidelines.

According to another example ("Example 20"), further to the system of Example 15, sliding door is frameless and includes a floor seal, and further including a floor guide including an inclined portion configured to facilitate movement of the floor seal along and within the floor guide when the sliding door transitioning between the open configuration and the closed configuration.

According to another example ("Example 21"), further to the system of Example 20, wherein the floor seal is configured to friction fit with the frameless sliding door.

According to another example ("Example 21"), further to the system of Example 20, wherein the floor guide includes two different material properties to facilitate movement of the floor seal along and within the floor guide.

According to another example ("Example 23"), further to the system of Example 15, further including a data gasket arranged with the panel frame and configured to seal against electrical components and data ports routed with the panel frame.

According to another example ("Example 24"), further to the system of Example 15, further including a base trim arranged with the panel frame and a base trim gasket arranged along a length of the base trim configured to reduce air gaps between the base trim and the sliding door.

According to another example ("Example 25"), further to the system of Example 15, the ceiling gasket is a pair of ceiling gaskets.

The foregoing Examples are just that and should not be read to limit or otherwise narrow the scope of any of the inventive concepts otherwise provided by the instant disclosure. While multiple examples are disclosed, still other embodiments will become apparent to those skilled in the art from the following detailed description, which shows and describes illustrative examples. Accordingly, the drawings and detailed description are to be regarded as illustrative in nature rather than restrictive in nature.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Definitions and Terminology

Figure 1:
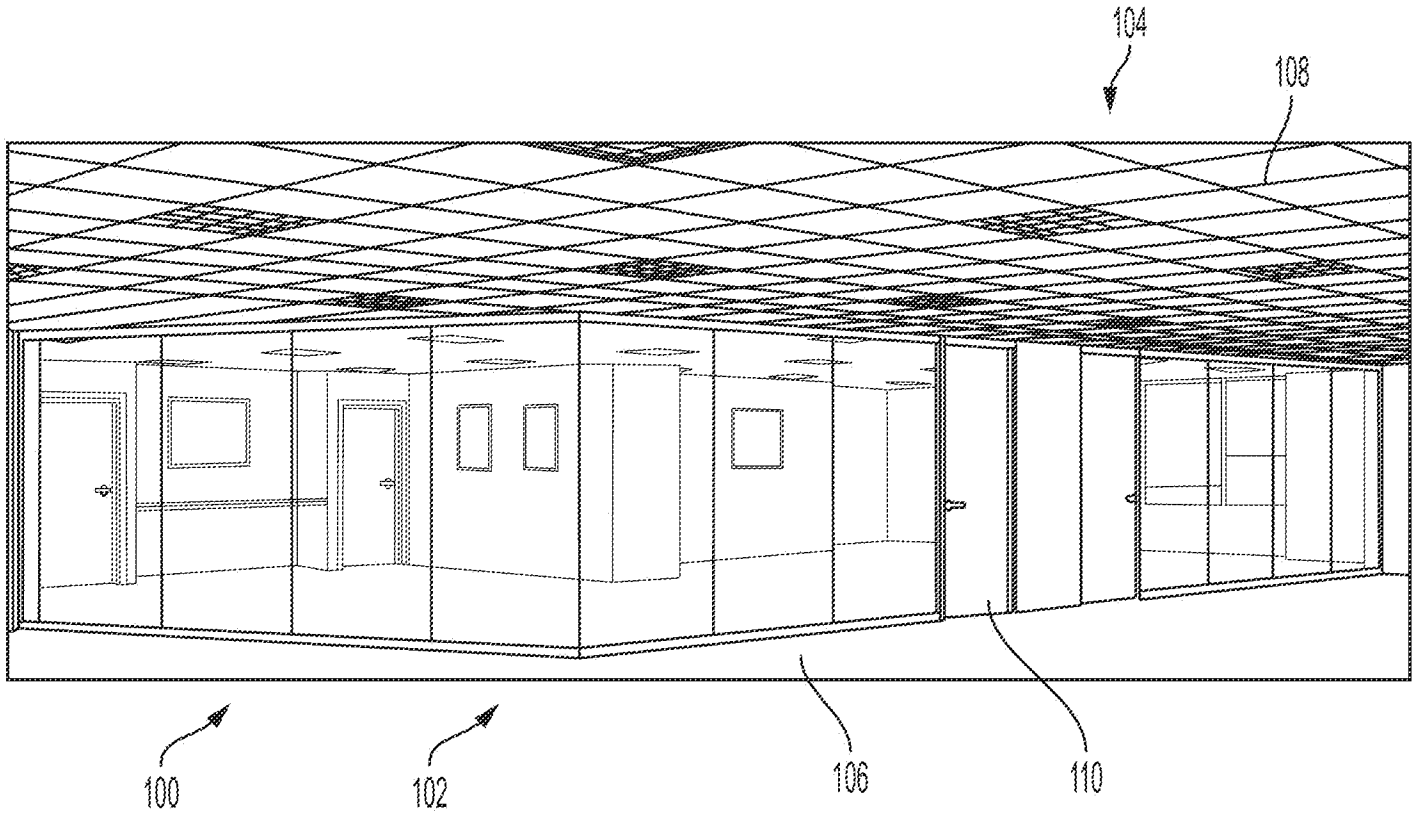
FIG. 1 is a perspective view of an office space assembly having been assembled with a wall panel system, in accordance with various aspects of the present disclosure.

This disclosure is not meant to be read in a restrictive manner. For example, the terminology used in the application should be read broadly in the context of the meaning those in the field would attribute such terminology.

With respect to terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error, differences in measurement and/or manufacturing equipment calibration, human error in reading and/or setting measurements, minor adjustments made to optimize performance and/or structural parameters in view of differences in measurements associated with other components, particular implementation scenarios, imprecise adjustment and/or manipulation of objects by a person or machine, and/or the like, for example. In the event it is determined that individuals having ordinary skill in the relevant arts would not readily ascertain values for such reasonably small differences, the terms "about" and "approximately" can be understood to mean plus or minus 10% of the stated value.

Description of Various Embodiments

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale but may be exaggerated to illustrate various aspects of the present disclosure, and in that regard, the drawing figures should not be construed as limiting.

Although the present invention as exemplified hereinafter was primarily designed for wall systems intended in work environments, for defining office spaces, etc., it could be used with other objects and for other purposes, as apparent to a person skilled in the art. For this reason, expressions such as "work", "office", "space", "wall", "panel" and any other references and/or other expressions equivalent thereto should not be taken as to limit the scope of the present invention and include all other objects and all other applications with which the present invention could be used and may be useful.

Moreover, in the context of the present invention, the expressions "system", "kit", "set", "assembly", "product" and "device", as well as any other equivalent expressions and/or compounds word thereof known in the art will be used interchangeably, as apparent to a person skilled in the art. This applies also for any other mutually equivalent expressions, such as, for example: a) "mount", "assemble", "define", "build", "erect", etc.; b) "wall", "panel", etc.; c) "office", "work space", "environment", "structure", "enclosure", etc.; d) "rotating", "driving", "displacing", "moving", "supporting", "conveying" etc.; e) "interchangeable", "modular", "progressive", etc.; f) "enable", "allow", "permit", etc.; g) "fastening", "securing", "attaching", "anchoring", "adjusting", "positioning", etc.; h) "hole", "bore", "slot", "slit", "groove", "cavity", etc.; i) "rotating", "pivoting", "turning", "rolling", etc.; j) "ceiling", "upper, "top", etc.; k) "floor", "lower, "bottom", etc.; k) "glass", "laminate", "panel", "gypsum", "board", etc.; l) "positioning", "spacing", "locating", "arranging", "disposing", etc.; m) "adjacent", "neighboring", "sequential", etc.; n) "components", "parts", "elements", etc.; as well as for any other mutually equivalent expressions, pertaining to the aforementioned expressions and/or to any other structural and/or functional aspects of the present invention, as also apparent to a person skilled in the art.

It will be considered that expressions such as "connected" and "connectable", or "mounted" and "mountable", may be interchangeable, in that the present invention also relates to a kit with corresponding components for assembling a resulting fully assembled office space.

FIG. 1 is a perspective view of an office space assembly having been assembled with a wall panel system, in accordance with various aspects of the present disclosure. The wall panel system 100 may include a plurality of wall panels 102, which may be a prefabricated frameless wall panel. Broadly described, the wall panel system 100 is a moveable and demountable wall panel system 100 for defining a space 104, such as an office space as shown, with the plurality of wall panels 102. The wall panels 102 are disposable in a substantially upright manner between a floor 106 and a ceiling 108. As shown in FIG. 1, the wall panel system 100 may include a door or doors 110 arranged with the plurality of panels 102. One of more of the door or doors 110, in certain instances, may be a sliding door as shown as described below.

Figure 2A:
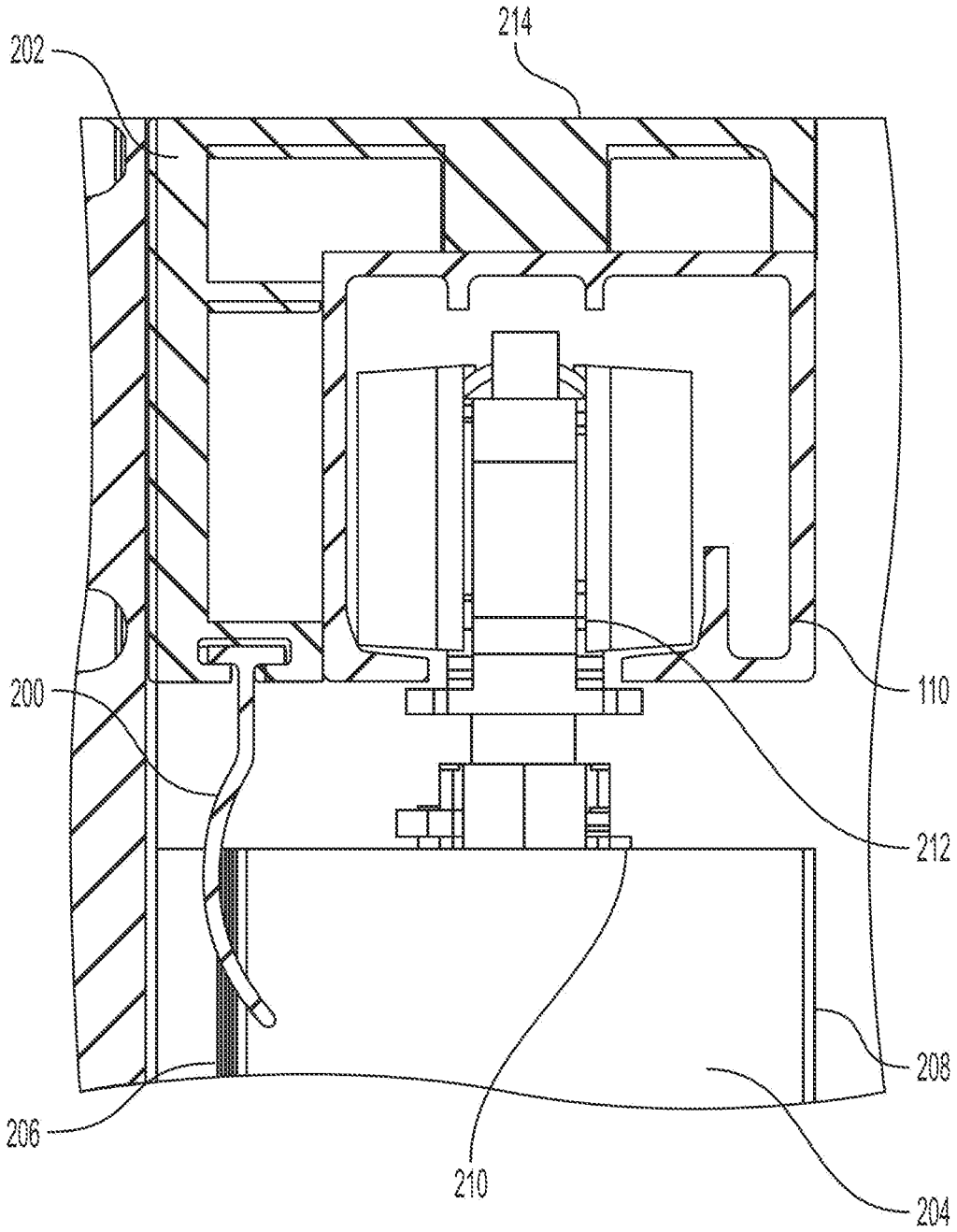
FIG. 2A is an example sliding track seal and panel frame, in accordance with various aspects of the present disclosure.

FIG. 2A is an example sliding track seal 200 and panel frame 202, in accordance with various aspects of the present disclosure. A sliding door 204 may be arranged within the panel frame 202. As shown in FIG. 1, the panel frame 202 may be included in the wall panel system 100 and the panel frame 202 may include a first panel member, a second panel member, a header 214 (shown in FIG. 2B) extending between the first panel member and the second panel member on a first side, a footer extending between the first panel member and the second panel member on a second side. In addition, the sliding door 204 may include a first vertical side 206, a second vertical side 208, an upper surface 210, and a lower surface (not shown). Sliding door hardware 212 may be coupled to the upper surface 210 of the sliding door 204 that is configured to translate the sliding door 204 within the panel frame 202. The sliding door 204 may be framed, frameless, or solid (e.g., wood).

In certain instances, the sliding track seal 200 (e.g., a gasket) may be arranged with the header 214 of the panel frame 202. As shown in further detail in FIG. 2C, the sliding track seal 200 may include a substantially linear portion 216 extending from the header 214 and a curved portion 218. The curved portion 218 may be configured to maintain contact with the sliding door 204 in a closed configuration, open configuration, and in transitioning between the open configuration and closed configuration.

As shown in FIG. 2A, the substantially linear portion 216 is approximately aligned with the first vertical side 206 of the sliding door 204. The substantially linear portion 216 (and curved portion 218) may facilitate creating and maintaining an acoustic seal between the sliding door 204 and the panel frame 202. In certain instances, the sliding track seal 200 (or gasket) is configured to acoustically seal a gap between the upper surface 210 of the sliding door 204 and the panel frame 202 and maintain low friction contact between the sliding door 204 (e.g., the upper surface 210) and the panel frame 202 in transitioning between the open configuration and closed configuration. The low friction contact may be to maintain function of use within ADA guidelines. The curved portion 218 may be curved to maintain contact with the first vertical side 206 of the sliding door 204 to allow for the sliding door 204 to slide within the panel frame 202 without substantially obstructing the movement. In addition, the curved portion 218 may close a space or gap between the sliding door 204 and the panel frame 202. The sliding track seal 200 may extend along an entire length of the panel frame 202.

Figure 2B:
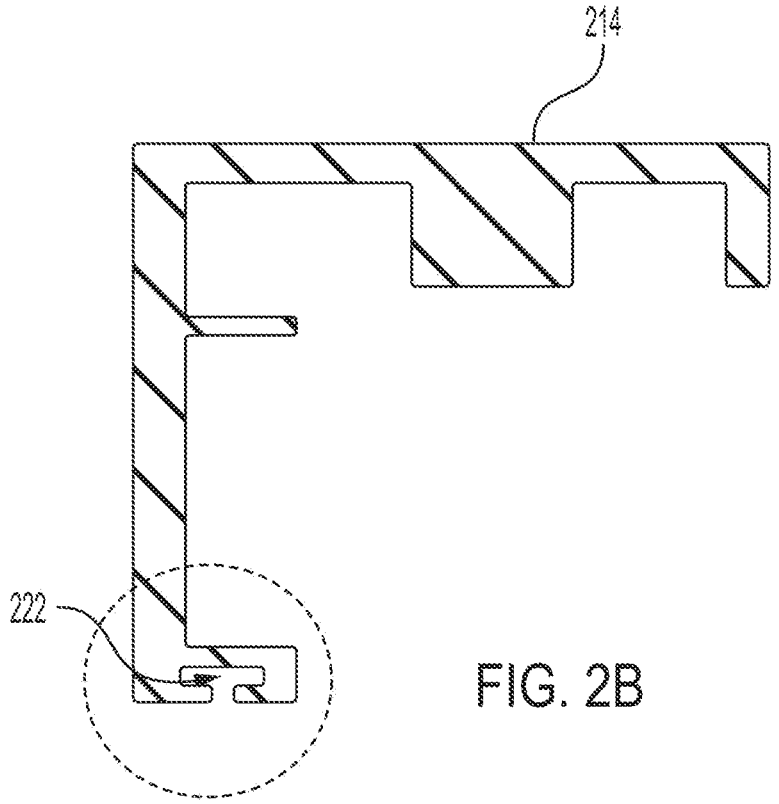
FIG. 2B is an isolated view of the panel frame shown in FIG. 2A, in accordance with various aspects of the present disclosure.
Figure 2C:
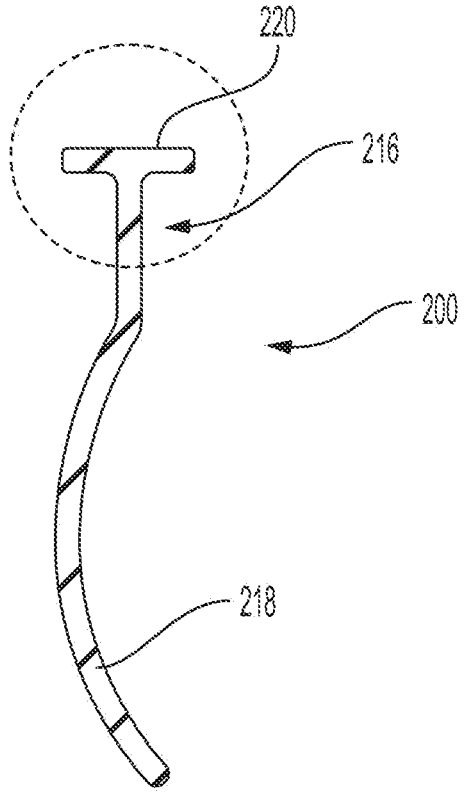
FIG. 2C is an isolated view of the sliding track seal shown in FIG. 2A, in accordance with various aspects of the present disclosure

In certain instances, and as shown in FIG. 2B, the header 214 of the panel frame 202 includes a t-shaped slot 222 configured to interface with a corresponding t-shaped portion 200 of the sliding track seal 200. The t-shaped slot 222 and the t-shaped portion 220 of the sliding track seal 200 may maintain stability of the sliding track seal 200 within the panel frame 202.

Figure 3A:
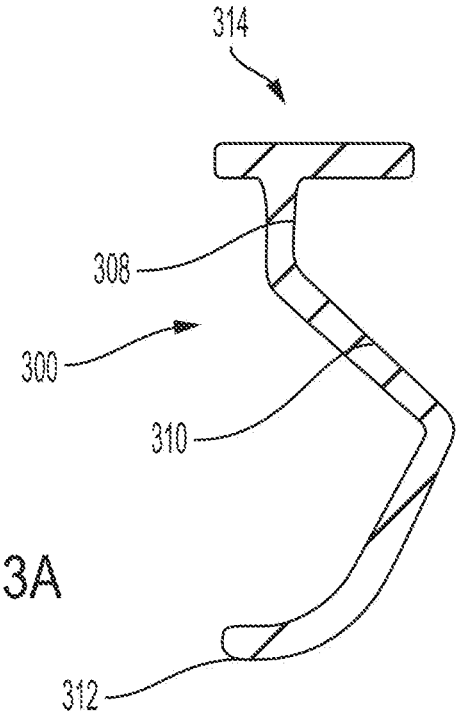
FIG. 3A is an example illustration of a footer seal, in accordance with various aspects of the present disclosure.
Figure 3B:
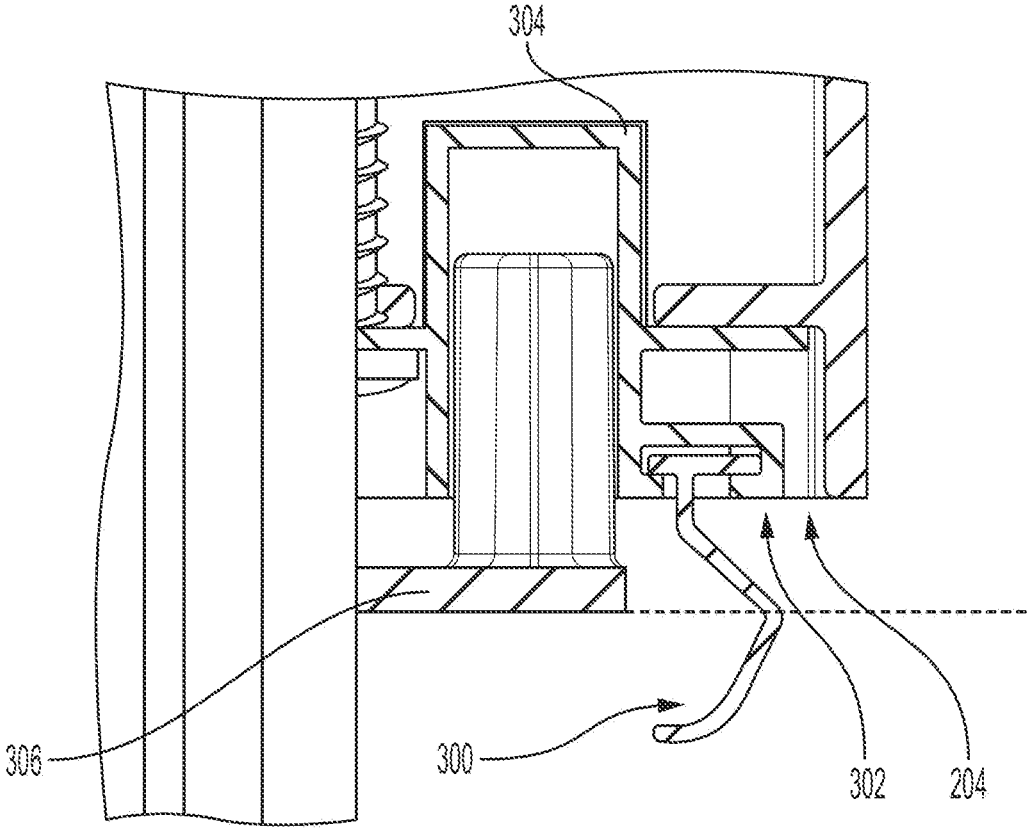
FIG. 3B is an example illustration of the footer seal, shown in FIG. 3A, and a sliding door, in accordance with various aspects of the present disclosure.
Figure 4A:
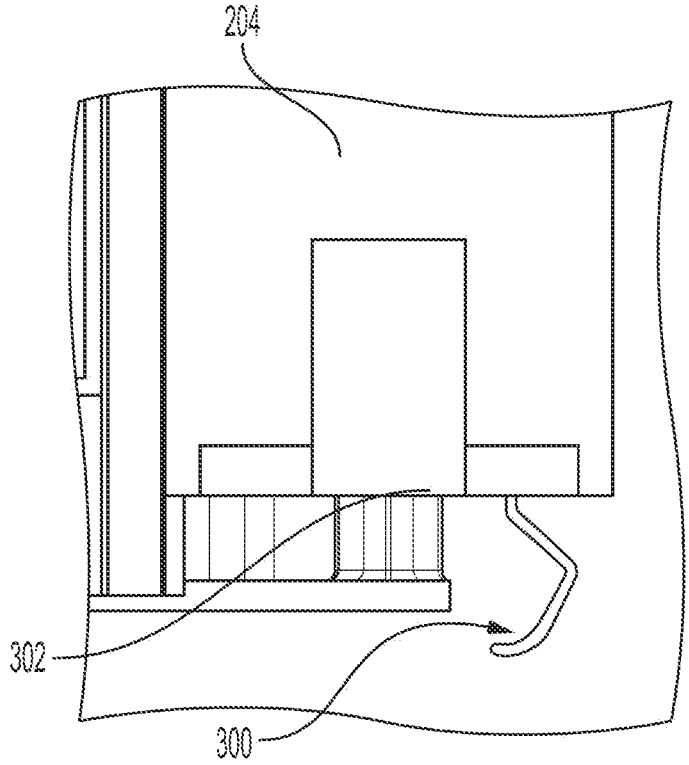
FIG. 4A is another example illustration of a footer seal and sliding door, in accordance with various aspects of the present disclosure.
Figure 4B:
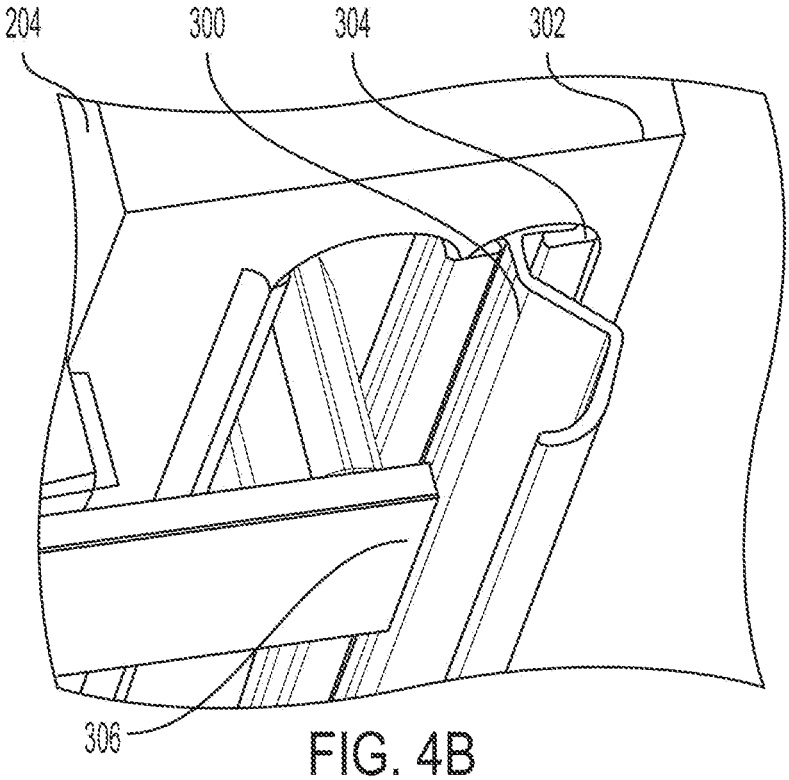
FIG. 4B is perspective view of the footer seal and sliding door, shown in FIG. 4A, in accordance with various aspects of the present disclosure.
Figure 4C:
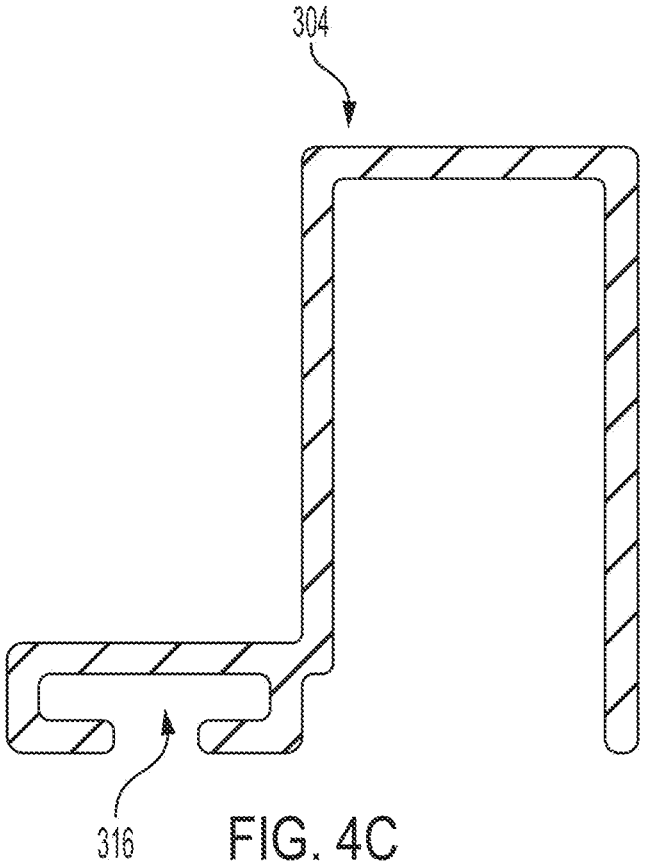
FIG. 4C is an isolated view of the panel frame shown in FIG. 4B, in accordance with various aspects of the present disclosure.

FIG. 3A is an example illustration of a footer seal 300 (e.g., a second gasket), in accordance with various aspects of the present disclosure. The footer seal 300 may be arranged with a lower surface 302 of the sliding door 204 as shown in FIG. 3B. The sliding door 204 shown in FIG. 3B may be a framed door. As shown in FIGS. 4A-B, the sliding door 204 may be a solid wood door with the footer seal 300 arranged with the lower surface 302 of the sliding door 204. In certain instances, and as shown in FIG. 3B and FIGS. 4B-C, the lower surface 302 of the sliding door 204 may include a channel 304 configured to position the footer seal 300 relative to the sliding door 204. In certain instances, the channel 304 configured to position the footer seal 300 outside a floor guide 306.

In certain instances, and as shown in FIG. 3A, the footer seal 300 may include a first linear section 308, a first bend section 310, and a second bend section 312. In certain instances, the first linear section 308, the first bend section 310, and/or the second bend section 312 may include a variable width. In certain instances, the first linear section 308 decreases in width adjacent to the first bend section 310. In certain instances, the first bend section 310 may decrease in width adjacent to the second bend section 312.

In certain instances, the footer seal 300 is configured to compress between the lower surface 302 of the sliding door 204 and a floor to acoustically seal a gap between the lower surface 302 of the sliding door 204 and the floor. In addition, the footer seal 300 may maintain low friction contact between the lower surface 302 of the sliding door 204 and the floor in transitioning between the open configuration and closed configuration. The low friction contact may be to maintain function of use within ADA guidelines. In certain instances, the first linear section 308 has less width adjacent to the first bend section 310 and may facilitate compression of the second bend section 312 in a direction up toward the first linear section 308. The footer seal 300 may not be visible and may be hidden by the sliding door 204. In certain instances, the footer seal 300 includes a t-shaped upper section 314 configured to interface with a t-shaped slot 316 as shown in FIG. 4C.

Similar to the sliding track seal 200, and as shown in FIG. 4A, the footer seal 300 may extend the length of the sliding door 204.

Figure 5A:
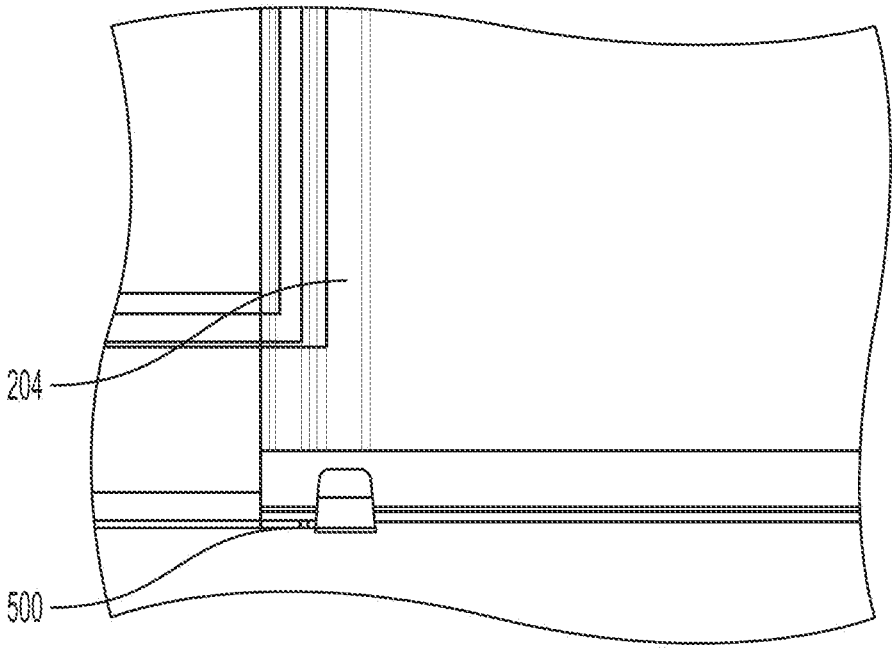
FIG. 5A is an illustration of an example floor guide and sliding door, in accordance with various aspects of the present disclosure.
Figure 5B:
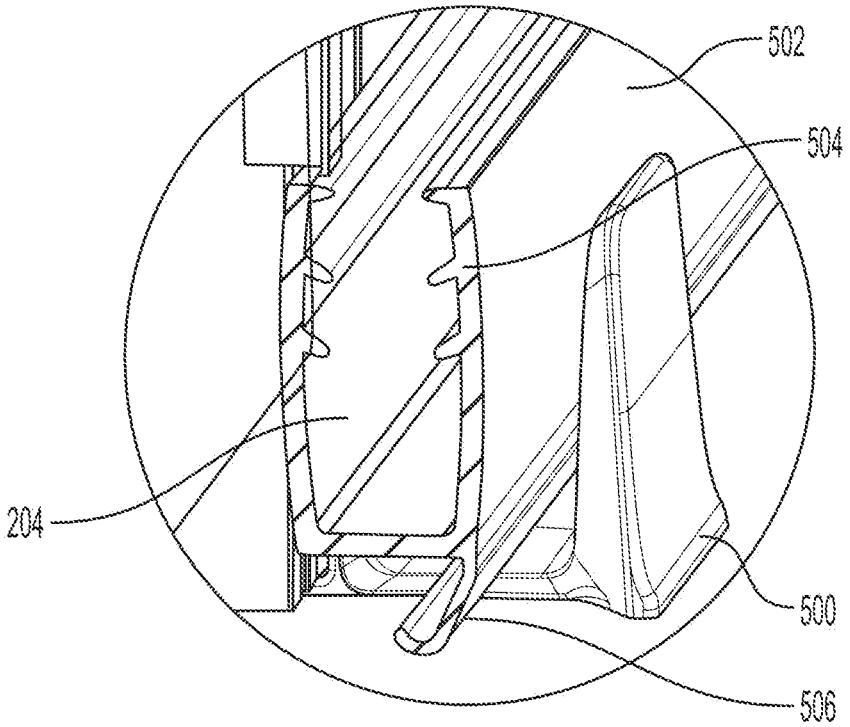
FIG. 5B is close-up perspective view of the floor guide and sliding door, shown in FIG. 5A, in accordance with various aspects of the present disclosure.

FIG. 5A is an illustration of an example floor guide 500 and sliding door 204, in accordance with various aspects of the present disclosure. FIG. 5B is close-up perspective view of the floor guide 500 and sliding door 204, shown in FIG. 5A, in accordance with various aspects of the present disclosure. The sliding door 204 may be frameless and include a floor seal 502 in certain instances as shown in FIG. 5B. The floor seal 502 may be configured to friction fit with the frameless sliding door 204. In certain instances, the floor seal 502 includes a plurality of fingers 504 configured to grip the sliding door 204. The floor seal 502 may also include a sweep 506 configured to acoustically seal a gap between the sliding door 204 and the floor. In addition, the sweep 506 may maintain low friction contact between the sliding door 204 and the floor in transitioning between the open configuration and closed configuration. The low friction contact may be to maintain function of use within ADA guidelines.

The sweep 506 may contact the floor guide 500 in transitioning between the open configuration and closed configuration. In certain instances, the floor guide 500 includes an inclined surface 508 configured to raise the sweep 506 when the sliding door 204 is translating between the open configuration and closed configuration and guide the sweep 506 and the sliding door 204 within the floor guide 500 and shown in FIG. 5C. The inclined surface 508 may be configured to facilitate movement of the floor seal 502 along and within the floor guide 500.

Figure 5C:
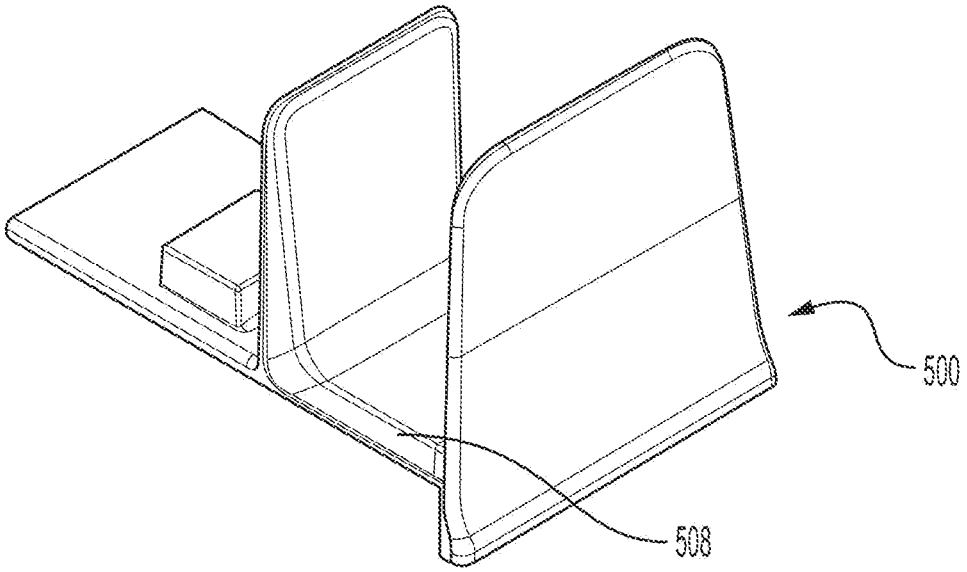
FIG. 5C is an isolated view of the floor guide, shown in FIGS. 5A-B in accordance with various aspects of the present disclosure.

The floor guide 500 may be of two or more hardness value durometers and/or formed of two different materials. In certain instances, the floor guide 500 includes two different material properties to facilitate movement of the floor seal 502 along and within the floor guide 500, which may include a u-shape as shown in FIG. 5C. In certain instances, the u-shaped portion of the floor guide 500 may be thicker and more rigid than other portions of the floor guide 500. In some instances, the floor guide 500 may be an injection molded polypropylene and the fingers 504 and the sweep 506 of the floor seal 502 may be plastic.

Figure 6:
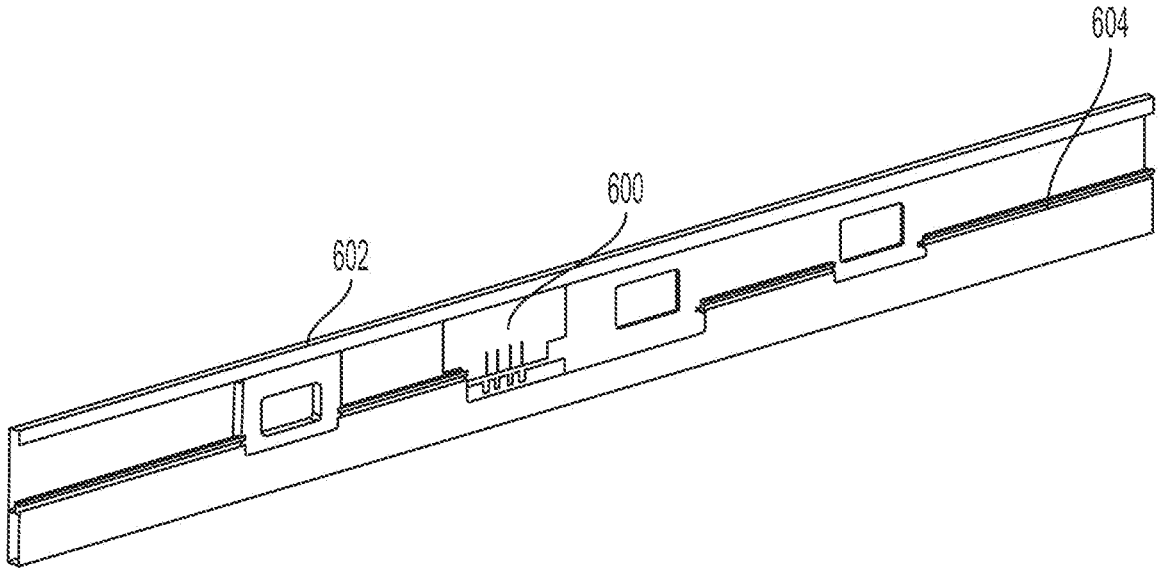
FIG. 6 is an illustration of example data gaskets arranged with a base channel, in accordance with various aspects of the present disclosure.

FIG. 6 is an illustration of example data gaskets 600, 602 arranged with a base channel 604, in accordance with various aspects of the present disclosure. The data gaskets 600, 602 may be arranged with the panel frame 202(as shown in FIG. 2A) configured to seal against electrical components and data ports routed with the panel frame. The data gaskets 600, 602 may seal acoustic leaks that can exist around data ports or electrical components. The data gaskets 600, 602 may include notches or slits to fit around data connections. The data gaskets 600, 602 may apply pressure around edges of the ports or electrical components.

Figure 7:
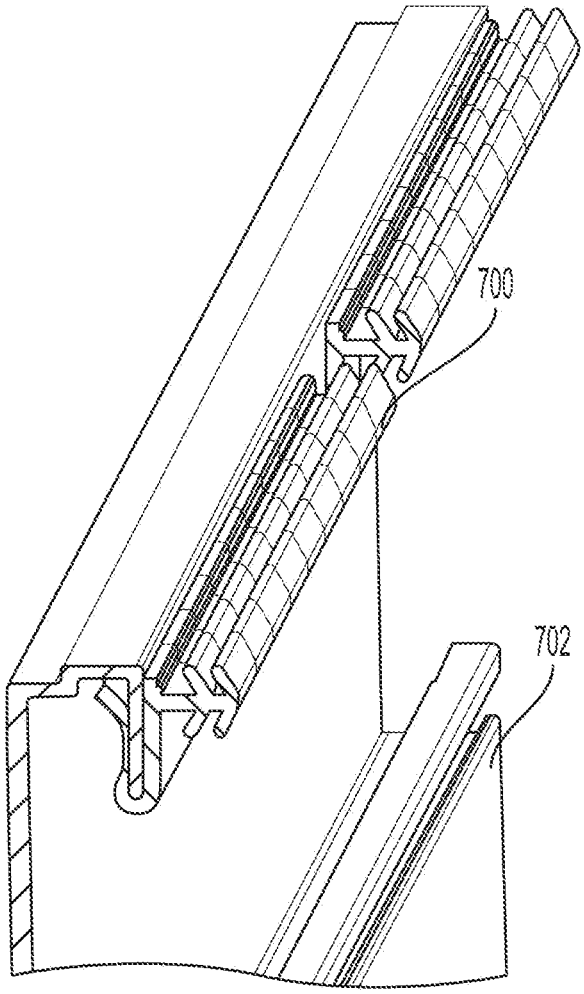
FIG. 7 is an illustration of an example base trim gasket, in accordance with various aspects of the present disclosure.

FIG. 7 is an illustration of an example base trim gasket 700, in accordance with various aspects of the present disclosure. In certain instances, the base trim gasket 700 may be arranged with a base trim 702 arranged with the panel frame 202 (shown in FIG. 2A). In certain instances, the base trim gasket 700 may be arranged along a length of the base trim 702 and configured to reduce air gaps between the base trim 702 and the sliding door. The base trim gasket 700 may be configured to apply compressive forces between the sliding door and the panel frame to reduce resonance of the door and increase acoustic performance.

Figure 8A:
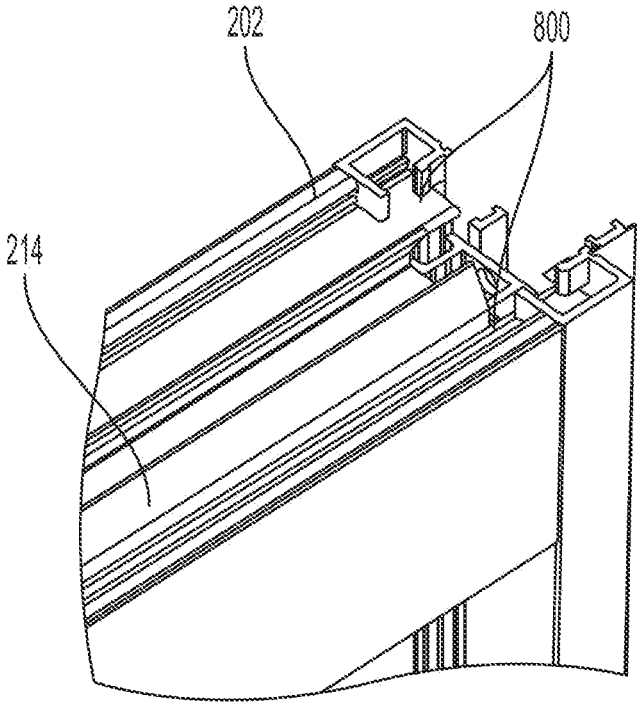
FIG. 8A is an example illustration of a sliding track seal and panel frame, in accordance with various aspects of the present disclosure.
Figure 8B:
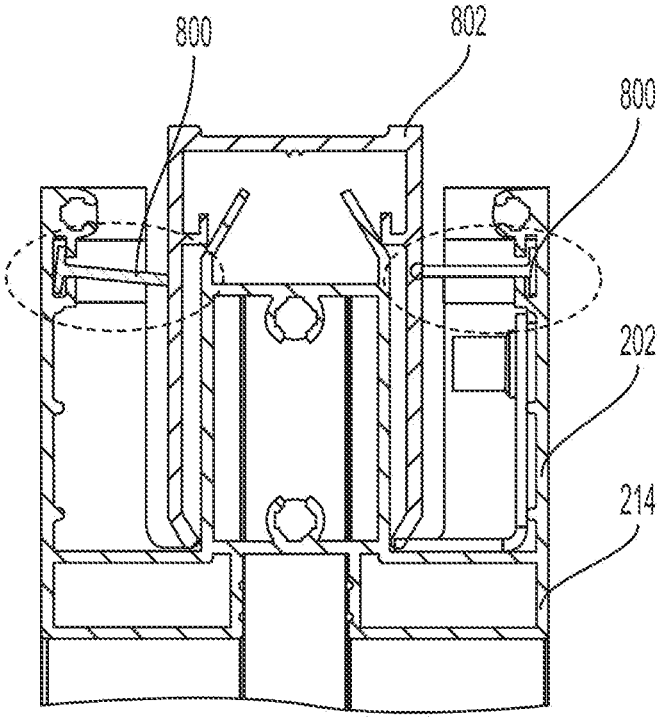
FIG. 8B is a side cross-sectional view of the sliding track seal and panel frame, shown in FIG. 8A, in accordance with various aspects of the present disclosure.

FIG. 8A is an example illustration of a ceiling gasket 800 and panel frame 202, in accordance with various aspects of the present disclosure. In certain instances, the modular wall systems discussed herein may include a ceiling channel sound seal 802 as shown in FIG. 8B. The ceiling gasket 800, or a pair of ceiling gaskets, may be arranged on either side of the ceiling channel sound seal 802. The ceiling channel sound seal 802 may configured to interface with the panel frame 202 (or other frame portions of the wall system).

In certain instances, the ceiling gasket 800, or pair of ceiling gaskets 800, may extend the length of the panel frame 202. The ceiling gasket 800 may be arranged with the ceiling channel sound seal 802 configured to close off an air gap between the panel frame 202 and the ceiling channel sound seal 802. The ceiling gasket 800, or the pair of ceiling gaskets, may be used with framed, clerestory, or integrated glass doors.

Figure 9A:
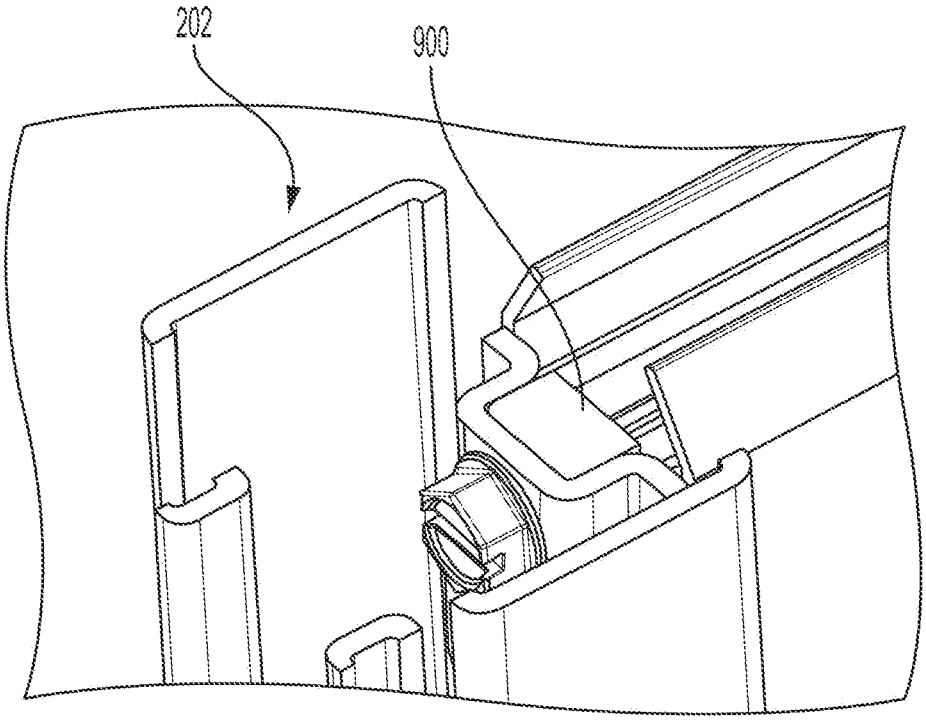
FIG. 9A is an illustration of an example corner insert and panel frame, in accordance with various aspects of the present disclosure.
Figure 9B:
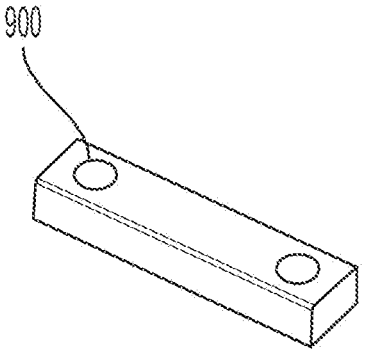
FIG. 9B is an illustrate of the example corner insert, shown in FIG. 9A, in accordance with various aspects of the present disclosure.

FIG. 9A is an illustration of an example corner insert 900 and panel frame 202, in accordance with various aspects of the present disclosure. FIG. 9B is an illustrate of the example corner insert 900, shown in FIG. 9A, in accordance with various aspects of the present disclosure. The corner insert 900 may be arranged at each horizontal-to-vertical corner of panel frame 202 or other panel used in the modular wall system. The corner insert 900 (or four corner inserts 900) may be arranged at, each corner of the panel frame 202 and may be configured to close air gaps between the sliding door 204 and the panel frame 202. The corner insert 900 may be integrated and mounted with the existing hardware. The corner insert 900 may be used with panel frames 202 that are solid.

Figure 10:
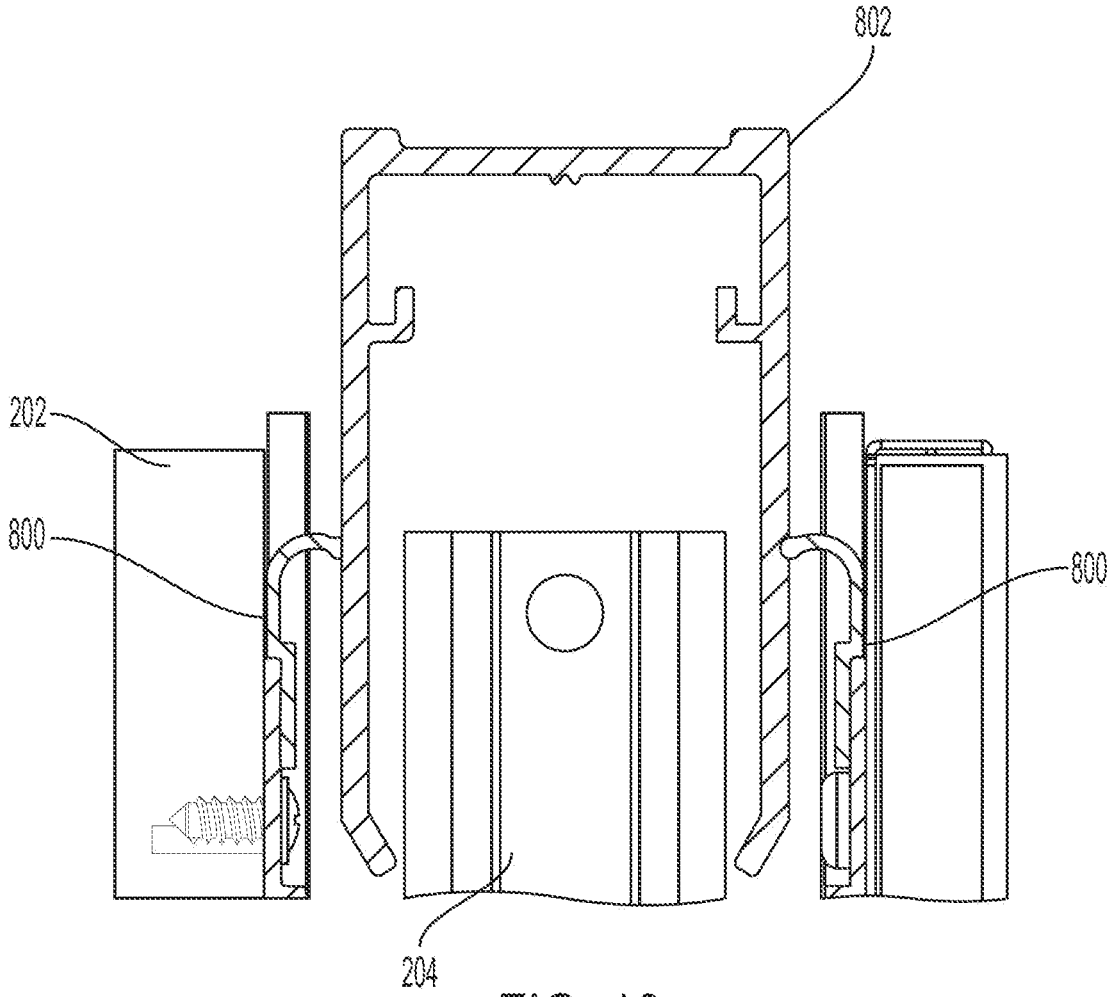
FIG. 10 is an illustrate on an example ceiling gasket and ceiling channel sound seal, in accordance with various aspects of the present disclosure.

FIG. 10 is an illustrate of an example ceiling gasket 800 and ceiling channel sound seal 802, in accordance with various aspects of the present disclosure. The ceiling gasket 800 or a pair of ceiling gaskets 800 may be configured to interface with the ceiling channel sound seal 802 (which is arranged with the panel frame 202) and be configured to block an air path between the panel frame 202 (or other system panel) and the ceiling channel sound seal 802. In certain instances, the ceiling gasket(s) 800 is configured to apply pressure to the ceiling channel sound seal 802 and block air flow from between the panel frame 202 (or other system panel) and the ceiling channel sound seal 802.

Figure 11:
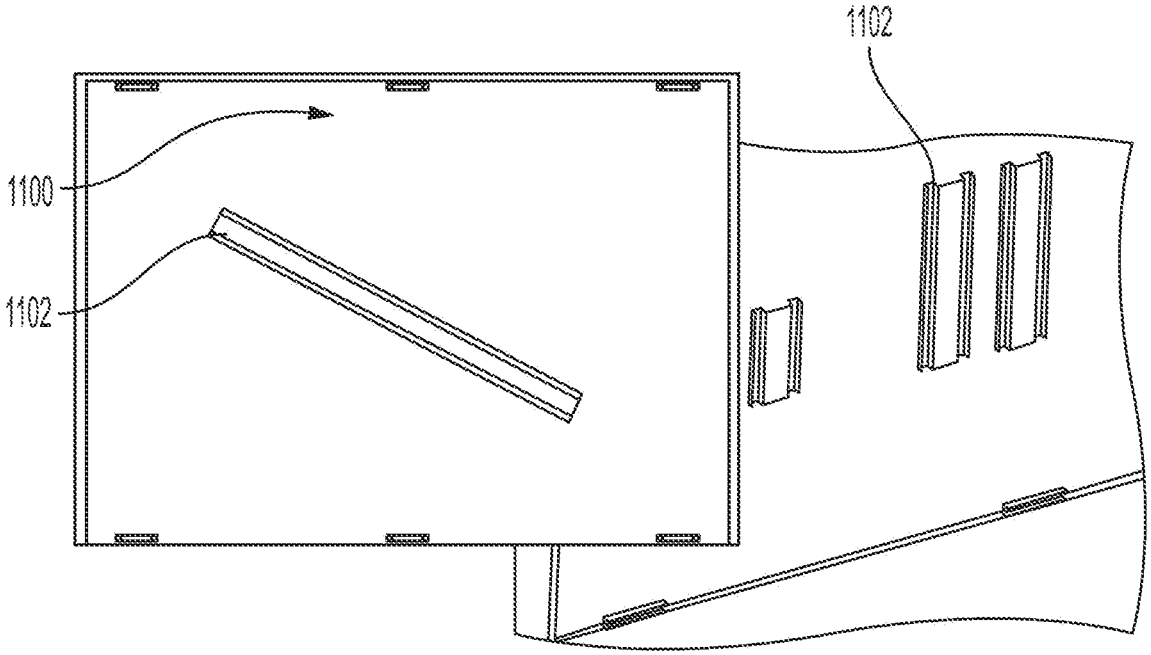
FIG. 11 is an illustration of an example panel and reinforcing member, in accordance with various aspects of the present disclosure.
Figure 12:
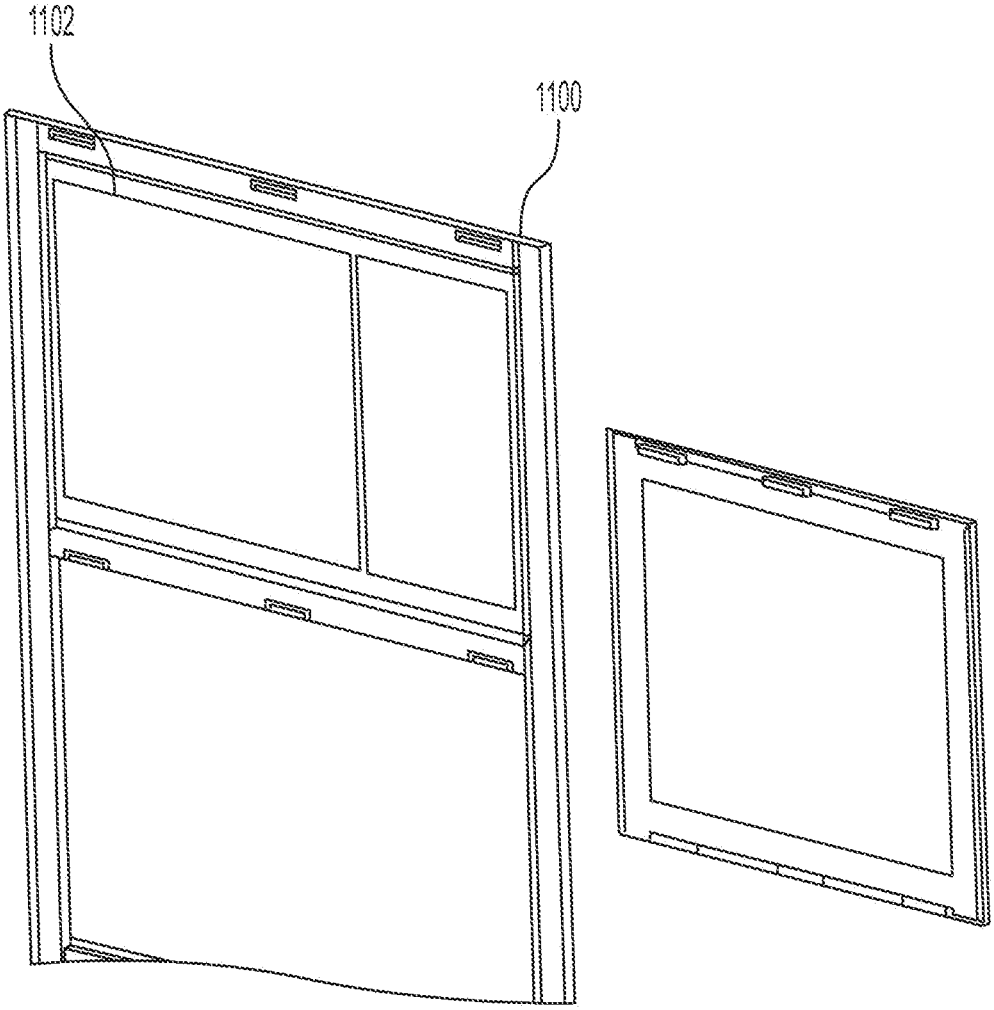
FIG. 12 is an illustration of an example panel and another example reinforcing member, in accordance with various aspects of the present disclosure.

FIG. 11 is an illustration of an example panel 1100 and reinforcing member 1102, in accordance with various aspects of the present disclosure. FIG. 12 is an illustration of an example panel 1100 and another example reinforcing member 1102, in accordance with various aspects of the present disclosure. The reinforcing member 1102 may be arranged with the panel 1100 and be configured to dampen acoustics that contact the panel 1100. The reinforcing member 1102 may be configured to disperse sound across the panel 1100. In certain instances, the reinforcing member 1102 is denser than the panel 1100. The reinforcing member 1102 may be segmented (as shown in FIG. 12) in certain instances. Further, the reinforcing member 1102 may be arranged at a center or approximately the center of the largest unstiffened area of the panel 1100. The reinforcing member 1102 may disperse sound due to the stiffness of the reinforcing member 1102 and/or the difference between the density of the reinforcing member 1102 and the panel 1100.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A modular wall system comprising:

a panel frame for use with a wall panel system including a first panel member, a second panel member, a header extending between the first panel member and the second panel member on a first side, a footer extending between the first panel member and the second panel member on a second side;

a sliding door including a first vertical side, a second vertical side, an upper surface, and a lower surface;

a sliding door hardware coupled to the upper surface of the sliding door configured to translate the sliding door within the panel frame; and a sliding track seal arranged with the header including a substantially linear portion extending from the header and a curved portion configured to maintain contact with the sliding door in a closed configuration, an open configuration, and in transitioning between the open configuration and the closed configuration; and a footer seal arranged with the lower surface of the sliding door and including a first linear section, a first bend section, and a second bend section, with at least one of the first linear section, the first bend section, and the second bend section including a variable width.

2. The system of claim 1, wherein the substantially linear portion is approximately aligned with the first vertical side of the sliding door.

3. The system of claim 1, wherein the header of the panel frame includes a t-shaped slot configured to interface with a corresponding t-shaped portion of the sliding track seal.

4. The system of claim 1, wherein the sliding track seal is configured to acoustically seal a gap between the upper surface of the sliding door and the panel frame and maintain contact between the upper surface of the sliding door and the panel frame in transitioning between the open configuration and the closed configuration.

5. The system of claim 1, wherein the footer seal is configured to compress between the lower surface of the sliding door and a floor to acoustically seal a gap between the lower surface of the sliding door and the floor and maintain contact between the lower surface of the sliding door and the floor in transitioning between the open configuration and the closed configuration.

6. The system of claim 1, wherein the sliding door is frameless and includes a floor seal, and further including a floor guide including an inclined portion configured to facilitate movement of the floor seal along and within the floor guide when the sliding door transitioning between the open configuration and the closed configuration.

7. The system of claim 6, wherein the floor seal is configured to friction fit with the frameless sliding door.

8. The system of claim 6, wherein the floor guide includes two different material properties to facilitate movement of the floor seal along and within the floor guide.

9. The system of claim 1, further including a data gasket arranged with the panel frame and configured to seal against electrical components and data ports routed with the panel frame.

10. The system of claim 1, further including a base trim arranged with the panel frame and a base trim gasket arranged along a length of the base trim configured to reduce air gaps between the base trim and the sliding door.

11. The system of claim 1, further including a ceiling channel sound seal arranged with the header of the panel frame and a ceiling gasket arranged with the ceiling channel sound seal configured to close off an air gap between the panel frame and the ceiling channel sound seal.

12. The system of claim 11, wherein the ceiling gasket is a pair of ceiling gaskets.

13. The system of claim 1, further including a corner insert arranged at each corner of the sliding door configured to close air gaps between the sliding door and the panel frame.

14. A modular wall system comprising:

a panel frame for use with a wall panel system including a first panel member, a second panel member, a header extending between the first panel member and the second panel member on a first side, a footer extending between the first panel member and the second panel member on a second side;

a sliding door including a first vertical side, a second vertical side, an upper surface, and a lower surface;

a sliding door hardware coupled to the upper surface of the sliding door configured to translate the sliding door within the panel frame; and a plurality of gaskets arranged with the panel frame or the sliding door configured to seal air gaps between the sliding door and the panel frame to acoustically seal the sliding door within the panel frame, the plurality of gaskets including at least one of: a sliding track seal including a substantially linear portion extending from the header and a curved portion configured to maintain contact with the sliding door in a closed configuration, an open configuration, and in transitioning between the open configuration and the closed configuration, a footer seal arranged with the lower surface of the sliding door and including a first linear section, a first bend section, and a second bend section, with at least one of the first linear section, the first bend section, and the second bend section including a variable width, a ceiling gasket arranged with a ceiling channel sound seal that is arranged with the header of the panel frame and configured to close off an air gap between the panel frame and the ceiling channel sound seal, and a corner insert arranged at each corner of the sliding door configured to close air gaps between the sliding door and the panel frame; and a data gasket arranged with the panel frame and configured to seal against electrical components and data ports routed with the panel frame.

15. The system of claim 14, wherein the substantially linear portion of the sliding track seal is approximately aligned with the first vertical side of the sliding door.

16. The system of claim 14, wherein the header of the panel frame includes a t-shaped slot configured to interface with a corresponding t-shaped portion of the sliding track seal.

17. The system of claim 14, wherein the sliding track seal is configured to acoustically seal a gap between the upper surface of the sliding door and the panel frame and maintain low friction contact between the upper surface of the sliding door and the panel frame in transitioning between the open configuration and the closed configuration.

18. The system of claim 14, wherein the footer seal is configured to compress between the lower surface of the sliding door and a floor to acoustically seal a gap between the lower surface of the sliding door and the floor and maintain contact between the lower surface of the sliding door and the floor in transitioning between the open configuration and closed configuration.

19. The system of claim 14, wherein the sliding door is frameless and includes a floor seal, and further including a floor guide including an inclined portion configured to facilitate movement of the floor seal along and within the floor guide when the sliding door transitioning between the open configuration and the closed configuration.

20. The system of claim 19, wherein the floor seal is configured to friction fit with the frameless sliding door.

21. The system of claim 19, wherein the floor guide includes two different material properties to facilitate movement of the floor seal along and within the floor guide.

22. The system of claim 14, further including a base trim arranged with the panel frame and a base trim gasket arranged along a length of the base trim configured to reduce air gaps between the base trim and the sliding door.

23. The system of claim 14, wherein the ceiling gasket is a pair of ceiling gaskets.

24. A modular wall system comprising:

a panel frame for use with a wall panel system including a first panel member, a second panel member, a header extending between the first panel member and the second panel member on a first side, a footer extending between the first panel member and the second panel member on a second side;

a sliding door including a first vertical side, a second vertical side, an upper surface, and a lower surface;

a sliding door hardware coupled to the upper surface of the sliding door configured to translate the sliding door within the panel frame;

a sliding track seal arranged with the header including a substantially linear portion extending from the header and a curved portion configured to maintain contact with the sliding door in a closed configuration, an open configuration, and in transitioning between the open configuration and the closed configuration; and a data gasket arranged with the panel frame and configured to seal against electrical components and data ports routed with the panel frame.

25. A modular wall system comprising:

a panel frame for use with a wall panel system including a first panel member, a second panel member, a header extending between the first panel member and the second panel member on a first side, a footer extending between the first panel member and the second panel member on a second side;

a sliding door including a first vertical side, a second vertical side, an upper surface, and a lower surface;

a sliding door hardware coupled to the upper surface of the sliding door configured to translate the sliding door within the panel frame; and a footer seal arranged with the lower surface of the sliding door and including a first linear section, a first bend section, and a second bend section, with at least one of the first linear section, the first bend section, and the second bend section including a variable width, the footer seal is configured to compress between the lower surface of the sliding door and a floor to acoustically seal a gap between the lower surface of the sliding door and the floor and maintain contact between the lower surface of the sliding door and the floor in transitioning between the open configuration and closed configuration.

* * * * *